US009671084B2

(12) United States Patent
Hayashi et al.

(10) Patent No.: US 9,671,084 B2
(45) Date of Patent: Jun. 6, 2017

(54) DISPLAY DEVICE

(71) Applicant: Kuroi Electric Co., Ltd., Kyoto (JP)

(72) Inventors: Nobuaki Hayashi, Kyoto (JP); Tadashi Hashimoto, Kyoto (JP)

(73) Assignee: Kuroi Electric Co., Ltd., Kyoto (JP)

( * ) Notice: Subject to any disclaimer, the term of this patent is extended or adjusted under 35 U.S.C. 154(b) by 5 days.

(21) Appl. No.: 14/806,972

(22) Filed: Jul. 23, 2015

(65) Prior Publication Data

US 2017/0023207 A1 Jan. 26, 2017

(51) Int. Cl.

| | |
|---|---|
| ***F21V 1/00*** | (2006.01) |
| ***F21V 7/00*** | (2006.01) |
| *F21Y 101/02* | (2006.01) |
| *F21Y 105/00* | (2016.01) |
| *F21Y 113/00* | (2016.01) |

(52) U.S. Cl.

CPC ..... *F21V 7/0083* (2013.01); *F21Y 2101/02* (2013.01); *F21Y 2105/003* (2013.01); *F21Y 2113/007* (2013.01)

(58) Field of Classification Search

CPC ..... F21V 7/0083; F21V 7/05; G02F 1/13304; G02F 1/13308; G02F 1/603; G02F 1/606; G02F 1/133611

IPC ..... F21V 7/0083,7/005; G02F 1/133604, 1/133608

See application file for complete search history.

(56) References Cited

U.S. PATENT DOCUMENTS

| | | | | |
|---|---|---|---|---|
| 5,647,152 | A | 7/1997 | Miura | |
| 8,237,887 | B2 * | 8/2012 | Tanaka | G02F 1/133606 349/62 |
| 8,628,229 | B1 * | 1/2014 | McNeil | F21V 15/01 362/249.02 |
| 2003/0058643 | A1 | 3/2003 | Barlow et al. | |
| 2006/0221612 | A1 * | 10/2006 | Song | G02F 1/133603 362/247 |
| 2007/0052662 | A1 * | 3/2007 | Kim | G02F 1/133605 345/102 |
| 2007/0070625 | A1 * | 3/2007 | Bang | G02F 1/133603 362/240 |
| 2007/0279936 | A1 * | 12/2007 | Song | G02F 1/133605 362/613 |
| 2010/0321610 | A1 * | 12/2010 | Tanaka | G02F 1/133606 349/62 |
| 2012/0075839 | A1 * | 3/2012 | Takada | G02B 5/201 362/97.1 |

(Continued)

FOREIGN PATENT DOCUMENTS

| | | | |
|---|---|---|---|
| JP | 07-261674 | A | 10/1995 |
| JP | 10-026943 | U | 1/1998 |
| JP | 2013-098083 | A | 5/2013 |

(Continued)

*Primary Examiner* — Ali Alavi

(74) *Attorney, Agent, or Firm* — Renner, Otto, Boisselle & Sklar, LLP

(57) ABSTRACT

A plurality of LED light sources that are mounted on a front face of a mounting plate are separated from each other respectively being disposed in cells of a partitioning wall. Inner faces of the respective cells are made of a material of low reflectivity. With respect to a normal line direction of the mounting plate, light of the LED light source is viewed, as light being brighter the closer to a back side and darker the closer to a near side on the inner face, in a state of being given gradations by the inner face.

1 Claim, 6 Drawing Sheets

(56) References Cited

U.S. PATENT DOCUMENTS

| | | | | |
|---|---|---|---|---|
| 2012/0268688 | A1* | 10/2012 | Sato | G02F 1/133603 349/62 |
| 2013/0057954 | A1* | 3/2013 | Nakahara | H04N 13/0404 359/463 |

FOREIGN PATENT DOCUMENTS

| | | | |
|---|---|---|---|
| KR | 20-2009-0004555 | A1 | 5/2009 |
| WO | WO 2004/053817 | A1 | 6/2004 |

* cited by examiner

DISPLAY DEVICE

BACKGROUND OF THE INVENTION

The present invention relates to a display device that displays an image and/or picture by means of light emitted from a plurality of light sources.

In recent years, many lighting systems use light emitting diodes (LEDs) in order to meet the requirements for power savings, and such a system has a plurality of LEDs arranged in a shape of a lattice each of which is a point light source. For a lighting system that obtains an illuminating light by projecting the light from the light sources toward a front side, it is required to distribute an amount of light as uniformly as possible over an entire area of a predetermined range.

To that end, as described in Japanese Patent Unexamined Publication No. 2013-098083 bulletin, for example, the lighting systems are provided with various kinds of reflector plates that control distribution directions of the light from each of the LEDs. The reflector plates are disposed in such a manner as to surround peripheral sides of the respective LEDs, and are provided with reflecting surfaces of high reflectivity that are inclined so as to reflect the light emitted from the respective LEDs to the front side. The light emitted from each LED is distributed to the front side of the lighting system either directly or after having been reflected by the reflecting surface (s) of the reflector plate(s).

However, in conventional lighting systems, the reflecting surfaces of the reflector plates are each configured so as to reflect the amount of light emitted from each of the LEDs as uniformly as possible over their respective entire surfaces, thereby giving the respective entire surfaces a look of brightness with a homogeneous gradation when viewed directly.

The present invention is directed to providing a display device capable of giving gradations to the light projected from each of a plurality of light sources and thereby capable of improving a rendering functionality through the creation of a feeling of depth when viewed directly.

SUMMARY OF THE INVENTION

A display device of the present invention includes a plurality of light sources and a partitioning wall. The plurality of light sources are arranged in a same plane with light distribution directions of the light sources being directed toward a front side. The partitioning wall has a certain length along a normal line direction of the plane, and separates the plurality of light sources from each other. A surface of the partitioning wall causes light emitted from each of the plurality of light sources to be reflected and diffused in a state of being given gradations such that an amount of light gradually decreases as a distance from the plane increases along the normal line direction.

DETAILED DESCRIPTION OF THE INVENTION

Figure 1:
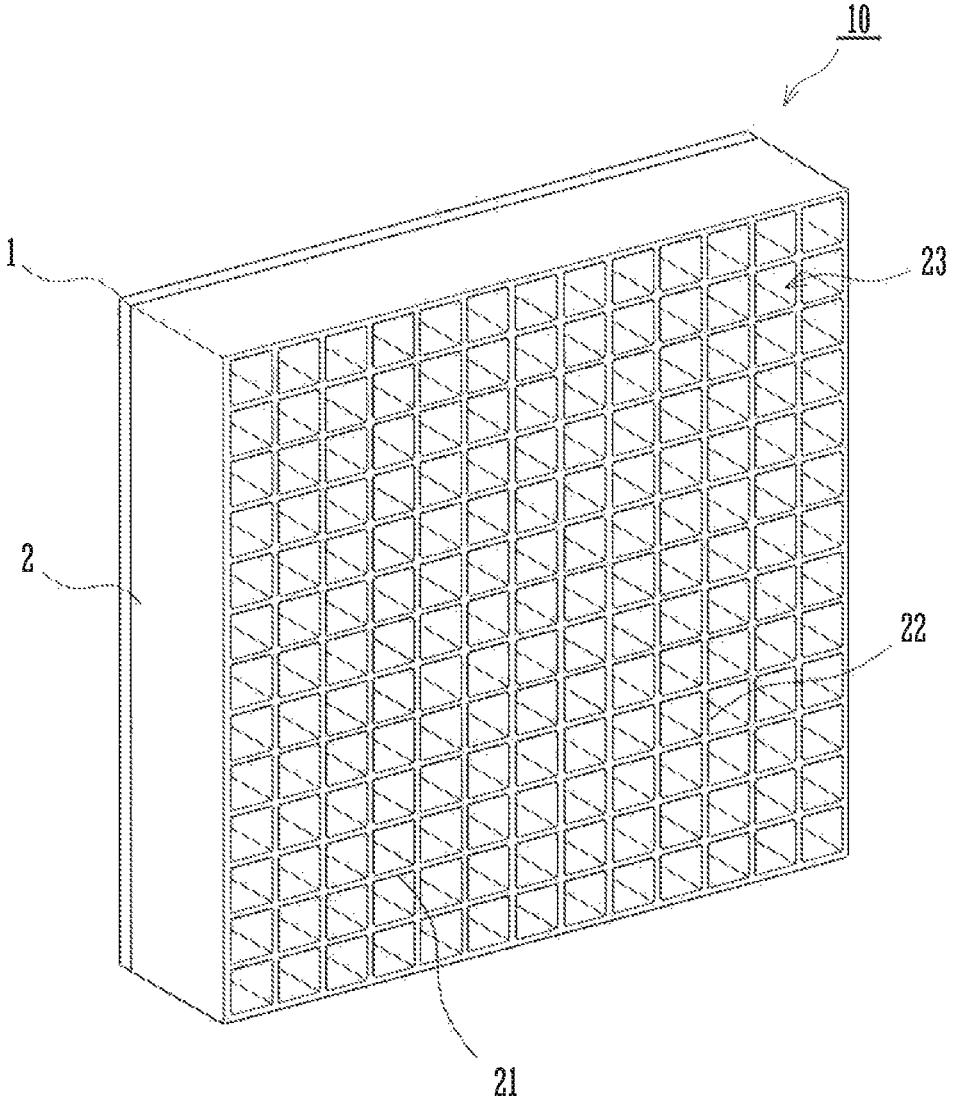
FIG. 1 is an external view of a display device according to a first embodiment of the present invention.

A display device according to an embodiment of the present invention is explained below, referring to the drawings.

As shown in FIG. 1, a display device 10 according to a first embodiment of the present invention includes a mounting plate 1 and a partitioning wall 2. The mounting plate 1 is a flat plate having a predetermined area. The partitioning wall 2 is an areal lattice consisting of a plurality of cells 23 having a rectangular cross section which are formed by combining two groups of a plurality of strip plates 21, 22 that are disposed on a front face's side of the mounting plate 1 so as to be respectively parallel to two directional lattice axes orthogonal to each other in a plane. The strip plates 21, 22 are made of a material of low reflectivity such as wood or the like. The partitioning wall 2 can be installed either by having a rear face thereof stuck fast onto a front face of the mounting plate 1, or with a predetermined gap between each other. For the strip plates 21, 22, it is sufficient that at least a face thereof located on an inside of the cell 23 has a low reflectivity; therefore, with an application of a surface roughing process or sheet sticking process onto the face located on the inside of the cell 23, the strip plates 21, 22, may be made using a material of high reflectivity, other than wood or the like.

Figure 2:
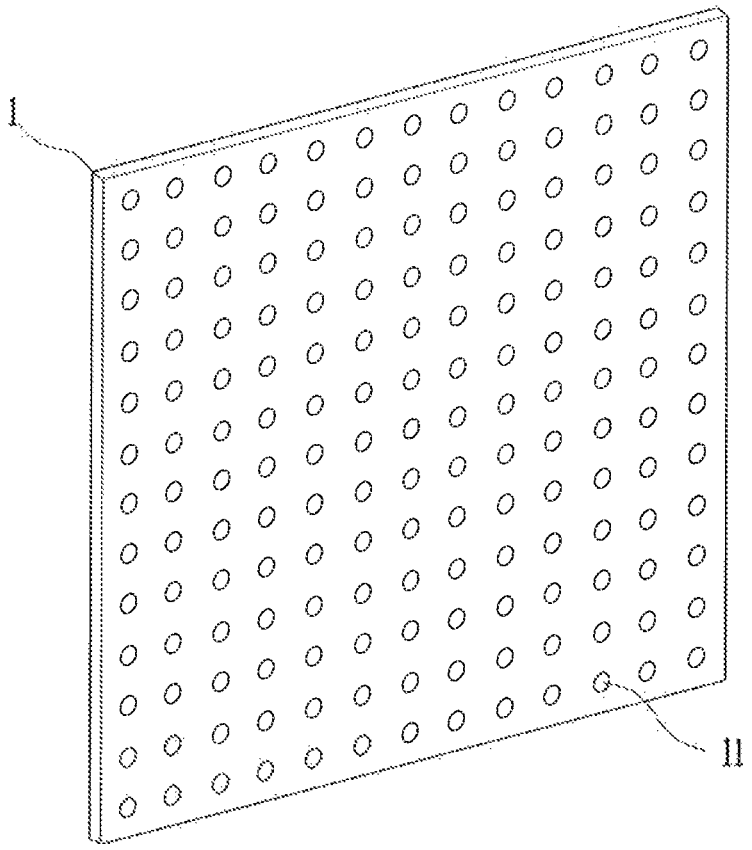
FIG. 2 is a drawing showing a state of an arrangement of a plurality of light sources in the display device.

As shown in FIG. 2, on the front face of the mounting plate 1, a plurality of LED light sources 11 are arranged at respective lattice points of an imaginary two-dimensional lattice of which two directional lattice axes are parallel to the strip plates 21, 22, respectively. The two-dimensional lattice at which points the LED light sources 11 are arranged is displaced in relation to the areal lattice of the partitioning wall 2 along the respective directions of the two lattice axes. Each of the plurality of LED light sources 11 is provided with a lens on a front side of a LED element that is mounted on a substrate, and therewith projects the light emitted by the LED element toward a generally hemispheric range on the front side of the substrate. The LED light source 11 corresponds to a light source of the present invention. Each of a plurality of light sources of the present invention does not necessarily consist of a single LED light source, but may consist of a plurality of LED light sources; also, other light emitting component(s) may be used.

Figure 3A:
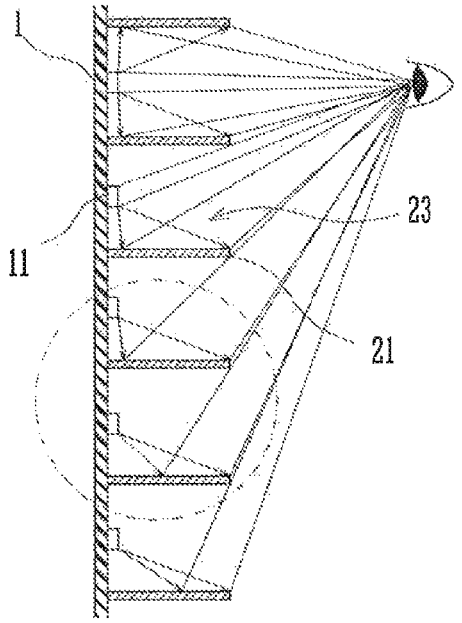
FIG. 3A is a side cross-sectional view showing a state of viewing of the display device.

As shown in FIG. 3A, in the display device 10, the plurality of LED light sources 11 are each located at a central part of a cell 23 of the partitioning wall 2 with respect to directions of the front face of the mounting plate 1. Additionally, the plurality of LED light sources 11, provided that each thereof is located separately inside each cell 23, may be located at respective positions that are displaced from the central parts of the plurality of cells 23 with respect to the directions of the front face of the mounting plate 1.

The positioning wall 2 separates the plurality of LED light sources 11 from each other. When the display device 10 is viewed from the front side in a state where the plurality of LED light sources 11 are turned on, the light emitted by LED light sources 11 that are near the eye position in front view is viewed directly whereas the light emitted by LED light sources 11 that are away from the eye position in front view is viewed after having been reflected by inner faces 23A of respective cells 23.

Figure 3B:
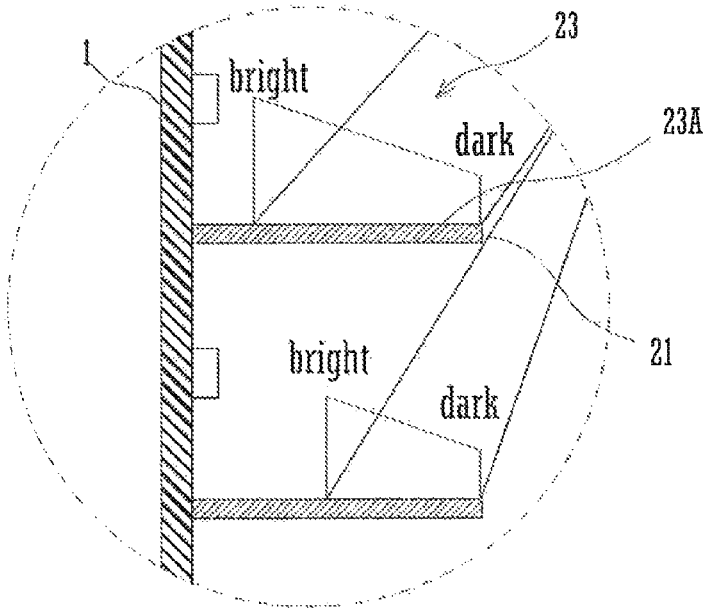
FIG. 3B is its enlarged view.

As shown in FIG. 3B, the inner face 23A of each cell 23 is designed so that reflexivity thereof decreases with respect to a direction of a normal line of the front face of the mounting plate 1, and thereby an amount of light reflected by the inner face 23A becomes more the closer to a back side where the LED light source 11 is located, and becomes less the closer to a near side from which the LED light source 11 is more distant. Therefore, the light of the LED light source 11 is viewed, as light being brighter the closer to the back side and darker the closer to the near side on the inner face 23A, in a state of being given gradations by the inner face 23A.

With the gradations, when an image is displayed using RGB-integrated LED light sources as the respective plurality of LED light sources 11, it is possible to give a planar image a three-dimensional feeling of depth, and thus to simulatively approach a three-dimensional image. Whereas, by constituting the plurality of LED light sources 11 using monochromatic LED light sources, it is also possible to use the display device 10 as one that can produce a feeling of depth with a quality different from the ordinary lighting systems.

Figure 4:
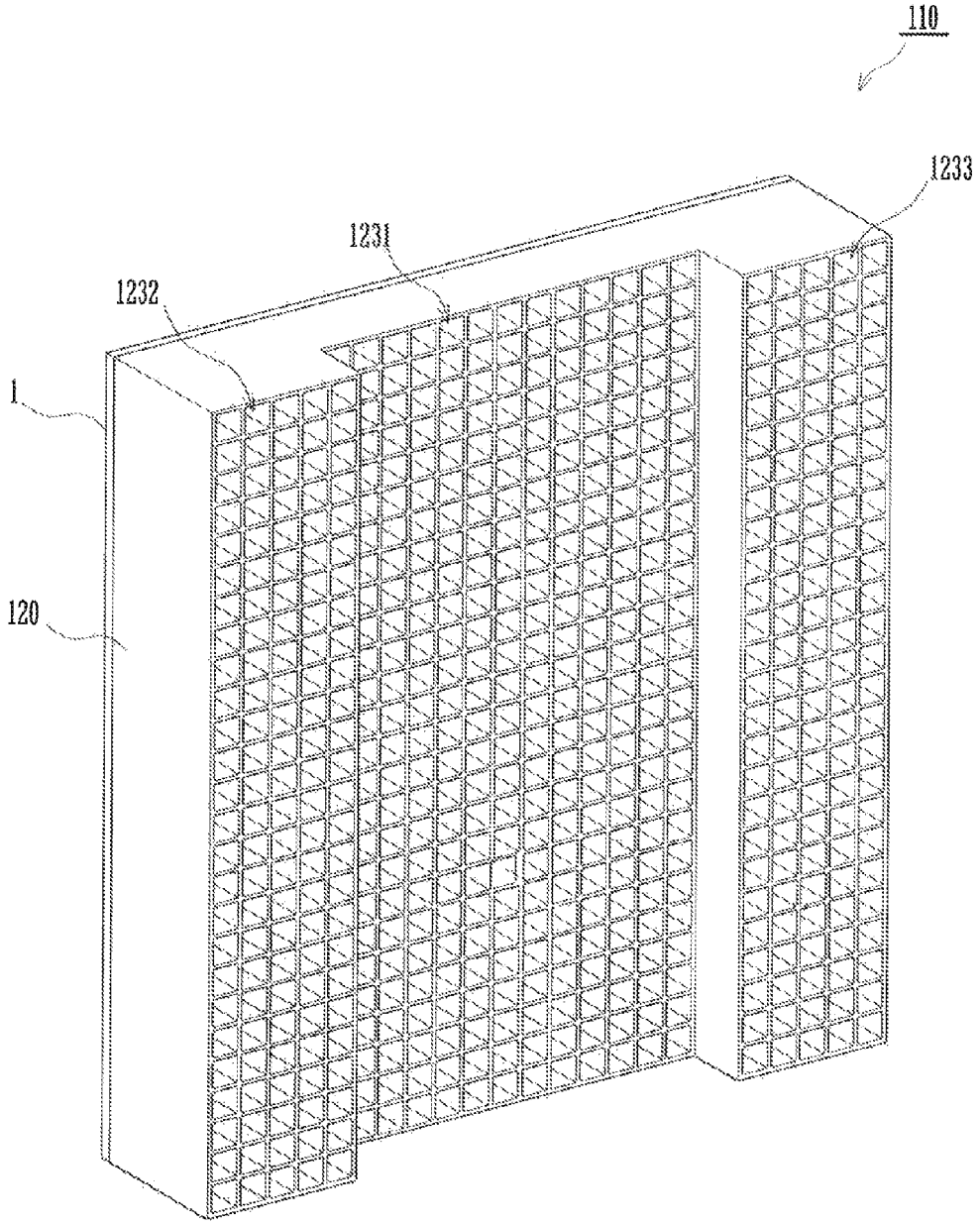
FIG. 4 is an external view of a display device according to a second embodiment of the present invention.

As shown in FIG. 4, a display device 110 according to a second embodiment of the present invention includes a partitioning wall 120 of which length (depth) in the direction of the normal line of the front face of the mounting plate 1 is partially different. The partitioning wall 120 has five left rows of cells 1232 and five right rows of cells 1233 of which depth is larger than that of central cells 1231. Therewith it is possible to change stereoscopic effect of an image between the left and right parts and the central part of the partitioning wall.

Further, by changing contents of images to be displayed by the plurality of LED light sources 11 that are respectively disposed inside a plurality of cells 1231, a plurality of cells 1232, and a plurality of cells 1233, it is also possible to give the images stereoscopic effects that depend on the contents. Moreover, it is also possible to use the display device 110 as one that can produce a feeling of depth with a quality different from the ordinary lighting systems.

The way of having partially different depths in the partitioning wall 120 is not limited to what is shown in FIG. 4, but can have partially different depths in vertical direction or have partially different depths in both right-and-left and vertical directions.

Figure 5A:
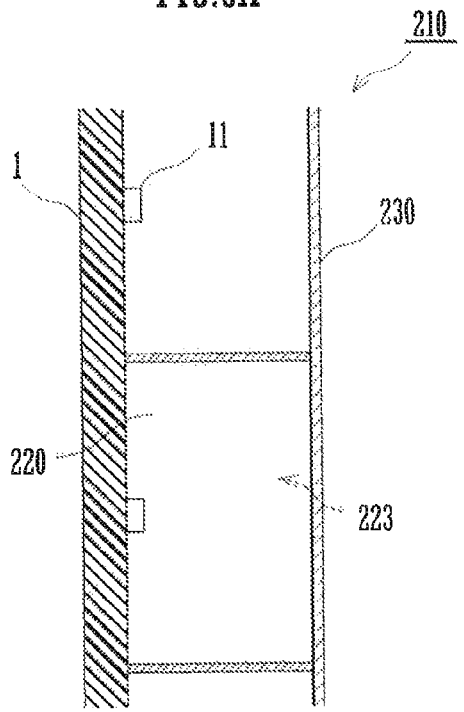
FIGS. 5A and 5B are partial sectional views of display devices according to a third and a fourth embodiments of the present invention, respectively.
Figure 5B:
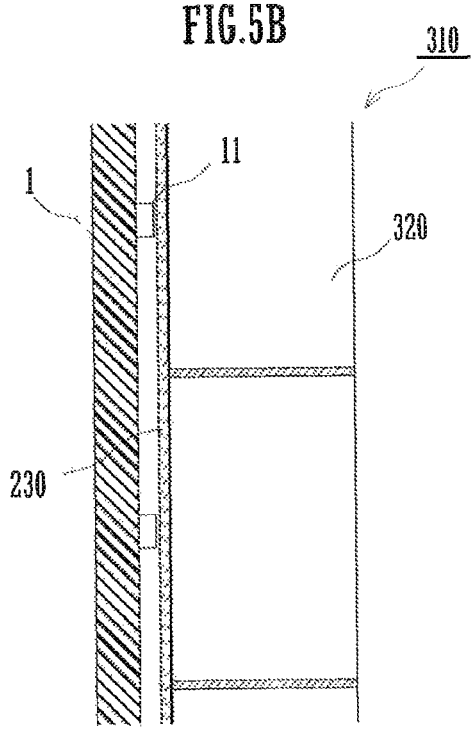

As shown in FIG. 5A, a display device 210 according to a third embodiment of the present invention includes a semitransparent sheet 230 disposed on a front face of a partitioning wall 220. As shown in FIG. 5B, a display device 310 according to a fourth embodiment of the present invention includes a gap provided between the front face of the mounting plate 1 and a rear face of a partitioning wall 320, and the semitransparent sheet 230 disposed on the rear face of the partitioning wall 320. With the display devices 210 and 310, it is possible not only to mitigate the visibility of images of the light sources but to give stereoscopic effects to planar images. Also, as shown in FIG. 5A, the sheet 230 disposed on the front face of the partitioning wall 220 can prevent the cells 223 from being soiled by dust; thus the sheet 230 may be transparent if only for the purpose of obtaining this effect.

Additionally, it is also possible to dispose the sheet 230 on the front face of only a part of the partitioning wall 220 or 230.

Figure 6A:
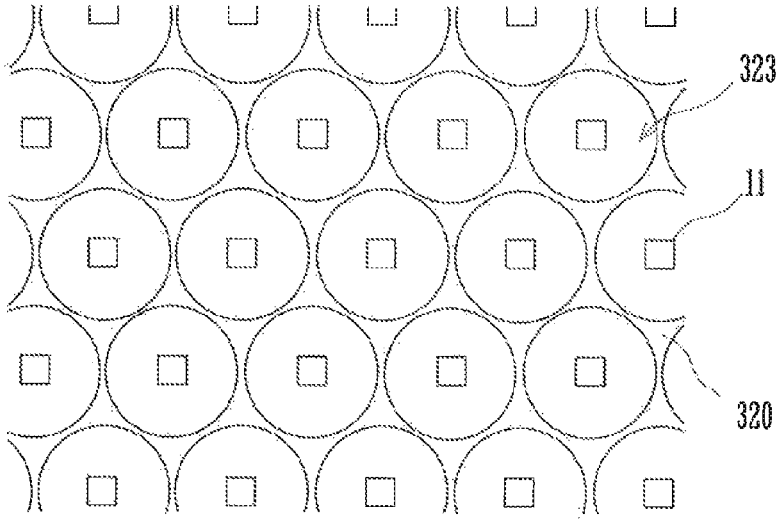
FIGS. 6A and 6B are front views of partitioning walls respectively provided in display devices according to other embodiments of the present invention.
Figure 6B:
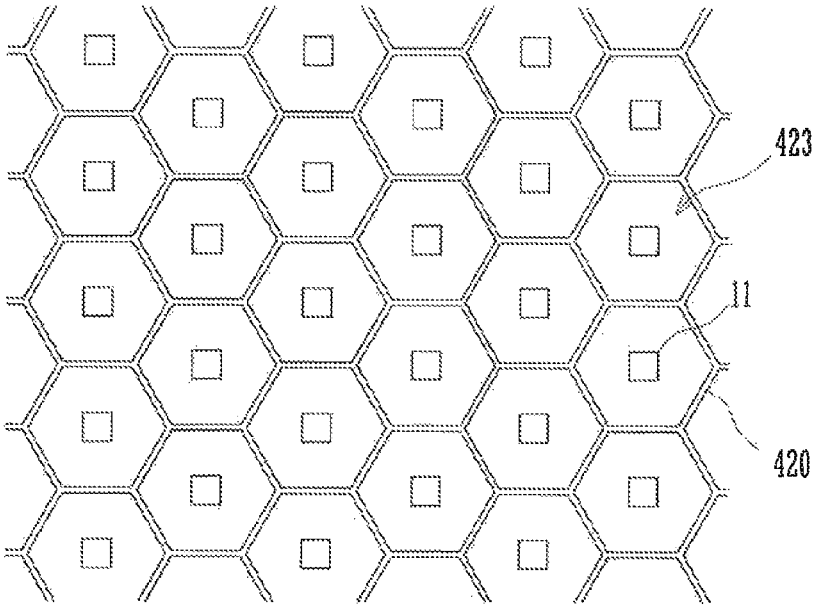

Also, as shown in FIG. 6A, cells 323 of the partitioning wall 320 can be made to have circular cross sections; or as shown in FIG. 6B, cells 423 can be made to have polygonal cross sections such as hexagon or the like. In any of these cases, on the front face of the mounting plate 1, the plurality of LED light sources 11 are arranged on respective lattice points of an imaginary two-dimensional lattice of which two directional lattice axes for arranging the plurality of LED light sources 11 are respectively rotated at predetermined angles.

The above explanations of the embodiments are nothing more than illustrative in any respect, nor should be thought of as restrictive. Scope of the present invention is indicated by claims rather than the above embodiments. Further, it is intended that all changes that are equivalent to a claim in the sense and realm of the doctrine of equivalence be included within the scope of the present invention.

What is claimed is:

1. A display device comprising:

a plurality of RGB-integrated LED light sources that are arranged in a same plane with light distribution directions of the light sources being directed toward a front side; and a plurality of cells each of which has a certain length along a normal line direction of the plane and separates the plurality of light sources from each other, wherein each of the light sources is located at the center of each of the cells.

* * * * *